US008256345B2

(12) United States Patent
Denninger et al.

(10) Patent No.: US 8,256,345 B2
(45) Date of Patent: Sep. 4, 2012

(54) PRINTING PRESS, METHODS FOR USING THE PRINTING PRESS, AND METHODS FOR HANDLING A WEB GUIDED THROUGH A PRINTING PRESS

(75) Inventors: Frank Peter Denninger, Hettstadt (DE); Tim Sven Ernst Heinisch, Kürnach (DE); Burkard Otto Herbert, Würzburg (DE); Werner Felix Scherpf, Margetschochheim (DE); Thomas Josef Zipper, Erlenbach (DE); Georg Winfried Zitterbart, Erlabrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/998,637

(22) PCT Filed: Oct. 15, 2009

(86) PCT No.: PCT/EP2009/063455

§ 371 (c)(1), (2), (4) Date: Jun. 16, 2011

(87) PCT Pub. No.: WO2010/054910

PCT Pub. Date: May 20, 2010

(65) Prior Publication Data

US 2011/0239879 A1 Oct. 6, 2011

(30) Foreign Application Priority Data

Nov. 14, 2008 (DE) ..... 10 2008 043 767

(51) Int. Cl.
*B41L 35/14* (2006.01)

(52) U.S. Cl. ..... 101/424.1; 101/488

(58) Field of Classification Search ..... 101/424.1
See application file for complete search history.

(56) References Cited

U.S. PATENT DOCUMENTS

| | | | | |
|---|---|---|---|---|
| 4,404,906 | A | | 9/1983 | Curran |
| 4,566,162 | A | * | 1/1986 | Brands ..... 26/105 |
| 5,184,555 | A | * | 2/1993 | Quadracci et al. ..... 101/417 |
| 5,224,640 | A | * | 7/1993 | Fokos et al. ..... 226/27 |
| 5,273,197 | A | * | 12/1993 | Wenk ..... 226/190 |
| 5,285,726 | A | * | 2/1994 | Ohta ..... 101/228 |
| 5,787,809 | A | | 8/1998 | Bosse |

(Continued)

FOREIGN PATENT DOCUMENTS

DE 30 22 557 A1 1/1982

(Continued)

*Primary Examiner* — Anthony Nguyen
(74) *Attorney, Agent, or Firm* — Mattingly & Malur, P.C.

(57) ABSTRACT

A printing press has at least one first printing tower with at least one first printing unit that has several offset printing couples which are usable to print on one or on both sides of a first web which runs through the first printing unit substantially from the bottom to the top. The web is printed in multiple colors in the first printing tower. A dryer is arranged downstream of the first printing unit and along the conveying path of the first web. A former structure, with at least one former through which the web runs, is located downstream of the dryer. At least one nipping roller is located downstream of the dryer and upstream of the former. A spreading device is provided between the dryer and the at least one nipping roller that is located upstream of the former and along the conveying path of the first web.

42 Claims, 6 Drawing Sheets

U.S. PATENT DOCUMENTS

| | | | | |
|---|---|---|---|---|
| 5,791,030 | A * | 8/1998 | Aihara et al. | 26/87 |
| 6,058,844 | A | 5/2000 | Niemiec | |
| 6,250,220 | B1 | 6/2001 | Sainio et al. | |
| 7,040,233 | B2 | 5/2006 | Seyfried | |
| 7,481,163 | B2 | 1/2009 | Theilacker | |
| 7,497,162 | B2 | 3/2009 | Potzkai | |
| 7,845,276 | B2 | 12/2010 | Eckert et al. | |
| 7,856,926 | B2 | 12/2010 | Thal | |
| 2004/0177780 | A1 | 9/2004 | Vroome | |
| 2007/0101881 | A1 * | 5/2007 | Bitzl et al. | 101/228 |
| 2009/0103965 | A1 * | 4/2009 | Ronecker et al. | 400/613 |

FOREIGN PATENT DOCUMENTS

| | | | |
|---|---|---|---|
| DE | 42 24 236 | A1 | 5/1993 |
| DE | 94 19 702.4 | U1 | 5/1995 |
| DE | 101 35 773 | A1 | 2/2003 |
| EP | 1 464 489 | A2 | 10/2004 |
| EP | 1 518 805 | A2 | 3/2005 |
| EP | 1 547 772 | A1 | 6/2005 |
| EP | 1 650 028 | A2 | 4/2006 |
| EP | 1 826 002 | A2 | 8/2007 |
| WO | 2005023690 | A1 | 3/2005 |
| WO | 2007020288 | A1 | 2/2007 |

* cited by examiner

PRINTING PRESS, METHODS FOR USING THE PRINTING PRESS, AND METHODS FOR HANDLING A WEB GUIDED THROUGH A PRINTING PRESS

CROSS-REFERENCE TO RELATED APPLICATIONS

This application is the U.S. national phase, under 35 U.S.C. 371, of PCT/EP2009/063455, filed Oct. 15, 2009; published as WO 2010/054910 A2 and A3 on May 20, 2010, and claiming priority to DE 10 2008 043 767.0, filed Nov. 14, 2008, the disclosures of which are expressly incorporated herein by reference.

FIELD OF THE INVENTION

The invention relates to a printing press, methods for using the printing press, and methods for handling a web guided through a printing press. The printing press is comprised of at least one printing tower having at least one first printing unit that has a plurality of offset printing couples for printing one or both sides of a web which passes through the printing unit substantially from the bottom to the top. The web is imprinted, in the first printing tower, in a multi-color process. A dryer is located downstream of the first printing unit in a path of web travel. A former structure, and having at least one fold former through which the first web passes, and at least one nipping roller are located downstream of the dryer and upstream of the fold former. A dampening or application device, that applies preferably an aqueous silicon solution to the web, is located after the dryer. A second web can also be printed in a multi-color process by a plurality of offset printing couples in at least a second printing unit of a second printing tower. The second web passes through the second printing tower, substantially from bottom to top and is then fed to the fold former without additional treatment by an activated dryer. The first web, which was imprinted in the first printing unit in heatset, is processed with the second web that was imprinted in the second printing unit in a coldset process to form a ribbon.

BACKGROUND OF THE INVENTION

WO 2005/023690 A1 describes a method for reducing register errors, i.e., errors in the relative positioning of two image points to be imprinted successively on the web, wherein a deformed or deformable roller is provided at the intake to the respective printing couple. In addition, a register adjustment can be carried out by increasing a temperature between two successive printing nips (printing couples) by means of a dryer for shrinkage, or by applying moisture, for example, in the form of saturated vapor, for expansion.

U.S. Pat. No. 4,404,906 A describes a device for controlling fan-out, i.e., web expansion caused by the penetration of moisture during the printing process, wherein the web to be imprinted is guided over a bowed roller upstream of the first printing couple.

EP 1 826 002 A2 discloses a printing press comprising at least one printing unit, a dryer positioned downstream thereof, a cooling roller assembly, a re-dampening device, and a folding unit, wherein for controlling web tension, the speed ratio of a positively driven cooling roller in relation to a positively driven main nipping roller located upstream in the web path can be adjusted.

DE 94 19 702 U1 describes a device for preventing the formation of waves in a printing press, wherein a web is deflected one or more times, each time in an opposite direction of curvature, by a spreading roller, immediately before said web reaches the first cooling roller of a cooling unit.

DE 30 22 557 A1 discloses a cooling system for a web-fed rotary printing press having a substantially vertical web path. To prevent crease formation, it is proposed, rather than using known spreading rollers upstream of nipping units, to embody at least one cooling roller of the cooling unit as having a diameter which increases substantially steadily from the center outward.

U.S. Pat. No. 6,058,844 A discloses a web-fed rotary printing press having a vertical web path, wherein in one embodiment, the cooling rollers are embodied with a reduced radius toward the outside, and in another embodiment, bowed spreading rollers are arranged in the cooling unit in addition to the cooling rollers. In the latter embodiment, the degree of web wrap is the determining factor for the spreading effect. To correct crease formation, the arc of the spreading roller is pivoted into the web plane.

U.S. Pat. No. 6,250,220 B1 discloses a spreading roller in a printing press having a substantially vertical web path, wherein upstream of the cooling rollers, a spreading roller is provided, which can be alternatively pivoted into the web path for production operation, or pivoted out of the web path for set up.

WO 2007/020288 A1 discloses a printing press that comprises a first printing tower with a first printing unit having an offset printing couple for printing one or both sides of a first web, a dryer arranged downstream of the first printing unit in the web path, along with a former structure having a fold former through which the first web passes and a nipping roller positioned upstream of the fold former. Said printing press also comprises a second printing tower with a second printing unit having an offset printing couple for printing one or both sides of a second web, wherein means for guiding the second web are provided, via which the second web can be or is guided, together with the first web, to the at least one fold former, without passing through a dryer, or at least without passing through an activated dryer.

EP 1 547 772 A1 discloses a sheet-fed offset printing press. The print substrate is first imprinted in corresponding printing couples using oil-based offset inks, and is then coated in a printing couple downstream using oil-based flat varnish that contains silicone varnish.

EP 1 518 805 A2 relates to a method for determining production-relevant material properties and a method for pre-adjustment. In the printing press, information regarding expansion characterization and moisture sensitivity of the infed web, etc., can be determined from corresponding variations, and corresponding pre-adjustment values for web tension can be determined.

SUMMARY OF THE INVENTION

The problem addressed by the invention is that of devising a printing press, methods for using the printing press, and methods for handling a web guided through a printing press which will enable the production of a defect-free product containing heatset pages, preferably using a modified newspaper printing press.

The problem is solved according to the invention by the provision of a spreading device that is located in the web path of the first web and between the dryer and the at least one nipping roller which is located upstream of the fold former. A positively driven roller, which is controllable at least with respect to its speed or its rotational angle position is provided in the web path of the first web, also downstream of the dryer but upstream of the spreading device. The first web that is guided over this positively driven roller is acted on by the spreading device which has force components that stretch the web transversely to its longitudinal direction before it is guided over the nipping roller which is located upstream of the fold former.

The advantages to be achieved with the invention consist particularly in that the implemented measures allow a product section to be produced, the image size of which can be influenced within certain limits, and/or which is produced without creases in heatset production. This is advantageous particularly for hybrid production from sections, which are made in part from coldset webs and in part from heatset webs, and are combined to form a combined product.

The set of problems associated with printing, particularly heatset printing—more particularly, with hybrid printing—can be summarized as follows: The web tension in the paper generates a stretching of the fiber lattice. This results in a longitudinal extension of the web, simultaneously with transverse contraction. These two changes have both an elastic and a plastic component. The applied moisture (ink, re-dampening agent) weakens the fiber connections, thereby increasing the plastic component. This component of the change is "frozen" during a drying process. Reducing the moisture from about 6%, for example, to about 1%, for example, causes the paper to shrink, and thereby also the print image or the printed page, particularly in the transverse direction.

Thus dryer temperature, initial dampness, and residence time in the dryer are primarily responsible for the shrinkage of a heatset web, and can therefore be used as control variables, within certain limits. The goal in this connection can be a low, but controlled, transverse contraction and a rapid attainment of equilibrium moisture. Uncoated newsprint paper, as a double- or even triple-width web, can "grow" in the dryer 20 mm, for example, and a lightly coated paper (LWC) can "grow" about 7 mm.

When equilibrium moisture is reached, part of the shrinkage is reversed. Depending upon the nature and the degree of re-dampening, this condition is reached sooner (i.e., by the time it reaches the delivery belt, for the most part) or later (up to hours). In order to achieve equilibrium moisture inside the press, enough water must be applied that the product is no longer saleable. In principle, re-dampening is dependent upon the amount of water supplied, the principle of action, the surface tension, the residence time/time of action, and the water absorbency of the paper.

By applying steady transverse tension (spreading) and advantageously selective dampening downstream and/or upstream of the dryer, as proposed in what follows, it is possible to influence the shrinkage behavior and the surfaces of the heatset web in a controlled manner.

In addition, for example, the effect of a spreading device is used to expand the options for increasing web tension to prevent crease formation, and to prevent insufficient tension at the fold former. For instance, in the region between cooling roller and former intake, tension can be increased without harmful constriction and/or longitudinal creasing.

This is of significant advantage particularly when different printing methods (heatset/coldset) and/or print substrates that behave differently with respect to expansion, growth, moisture absorption, etc., are to be processed together. In hybrid production, rather than taking the differences in the growth and/or shrinkage of the two different webs into consideration alone or primarily through different reel widths and different widths in the master print image (exposed printing forme) (substantial added logistical expense and potential for defects), significant influence can be exerted in the press itself by using the measures specified in greater detail below.

BRIEF DESCRIPTION OF THE DRAWINGS

Embodiment examples of the invention are illustrated in the set of drawings and will be specified in greater detail in what follows.

The drawings show.

Figure 1:
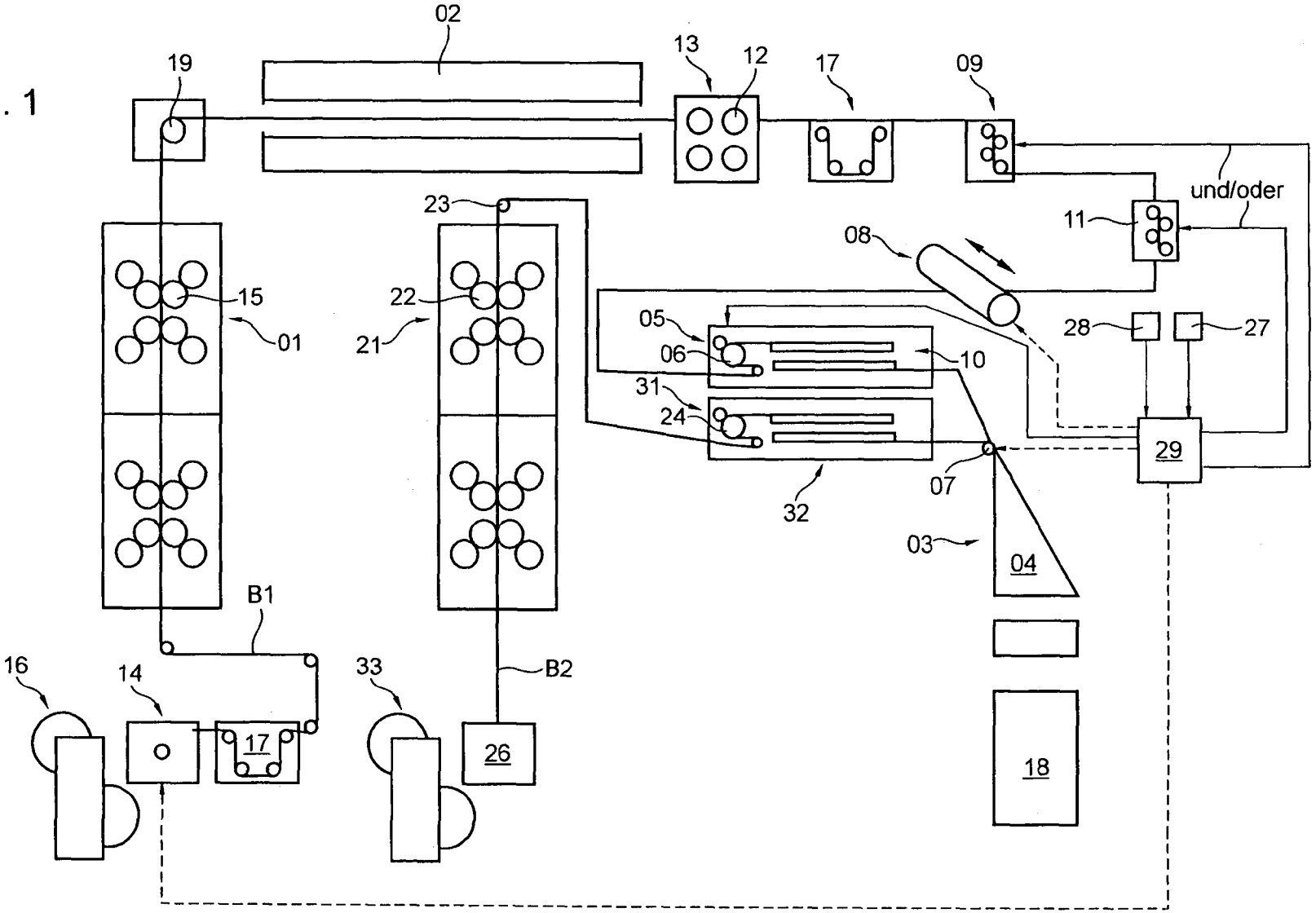
FIG. 1 a schematic illustration of a printing press in the form of a printing press, more particularly, a newspaper printing press, comprising a plurality of printing towers and embodied for hybrid production.

A printing press has one or more first printing units 01 (printing units of a first type and/or printing units that are operable or operated in a first operating mode), which in turn comprise one or more offset printing couples for printing one or both sides of a first web B1. The first printing units 01 are preferably embodied as printing towers, each of which has two stacked H-type printing units, for example, four bridge-type printing units for double-sided printing, as shown, or two stacked satellite printing units. The web B1 passes substantially vertically between the print positions in the first printing units 01 or printing towers.

The printing press can comprise a plurality of first printing units 01 or first printing towers—not depicted in the drawings in the interest of clarity—for imprinting first webs B1, which units or towers are capable of producing, entirely or partially, on the same former structure 03, and optionally on the same fold former 04, to increase product thickness.

Downstream of the at least one first printing unit 01, a dryer 02, more particularly, a radiant-heat dryer or thermal dryer, but preferably a thermal dryer 02, is provided in the web path for so-called heatset operation.

In one embodiment, the first printing unit 01 or first printing units 01 are embodied as so-called heatset printing unit 01, or are at least embodied such that they can be and/or are operated using heatset inks and/or UV inks. The heatset ink is characterized, for example, by special oils, for example, mineral oils, which evaporate under the influence of heat, thereby drying the imprinted web B1. The mineral oils have a boiling point range of 220° C.-320° C., for example. They can have a percentage by weight referred to the ink of approximately 25 to 40%. Because the ink does not need to be absorbed in order to dry, closed-pored paper surfaces can also be imprinted. However, UV inks have components which set under the influence of appropriate radiation (UV light).

In an alternative embodiment, the printing couples of the first printing unit 01 are embodied as operable in dry offset, i.e., without the application of dampening agent. In other words, they do not have dampening units, and the forme cylinders have corresponding printing forms configured for waterless offset printing. In this case, the inking unit of the printing couple is operated or operable using special inks for waterless offset printing (dry offset). In this embodiment of the printing unit 01, a web 01 imprinted by the printing unit 01 may or may not (coldset) be guided through a dryer 02, without requiring that the ink be changed for this purpose. In this case, despite the "heatset operation," i.e., the drying of the imprinted web B1, special heatset inks can be dispensed with.

Heatset operation is accordingly understood as an operating mode in which the imprinted web 01 is processed using an (active) dryer 02. Accordingly, a heatset web 01 is a web 01 which—after being partially or fully imprinted—is or will be processed using a dryer 02.

The first web 01 to be imprinted in the heatset process (i.e., with drying) is preferably embodied as a heatset web 01 comprising glazed and/or heavily coated paper having a coat weight of more than 5 g/m$^2$, for example, particularly more than 10 g/m$^2$ and/or having a base weight of greater than 40 g/m$^2$, for example, within a base weight range of 55-90 g/m$^2$.

The printing couples of the first printing unit 01 or of the first printing tower have a usable width for printing that corresponds, for example, to at least four, particularly four or six, printed pages in a vertical newspaper format in a broadsheet configuration, or in a horizontal newspaper format in a tabloid configuration, on the printing couple cylinders, i.e., in the jargon of newspaper printing presses, they are embodied as "double width" or "triple width." They are therefore embodied such that in at least one operating mode, they support or are able to support the print images of at least four, particularly of six, horizontal or vertical newspaper pages, side by side in the axial direction.

Downstream of the dryer 02, a former structure 03 is provided, having at least one fold former 04 through which the first web B1 passes. At least one nipping roller 06; 07, more particularly, at least one nipping roller 07 embodied as former roller 07, is situated upstream of the fold former 04. An additional nipping roller 06, for example, a nipping roller for a slitter 05, can also be provided upstream. This is the case when—as is preferred—a multiple-width (e.g., double or triple) web 01 will be imprinted and, before it reaches the former structure 03, will be cut into partial webs one or two pages in width, and, optionally, when a partial web will be offset laterally and/or dropped via a turning deck 10 having two turning bars. In the web path of the first web B1, a spreading device 08 is provided between the dryer 02 and the at least one nipping roller 06; 07 that is upstream of the fold former 04, more particularly, said spreading device is provided upstream of the nipping roller 06.

The spreading device can be of any embodiment in which force components acting outward simultaneously on the web B1 act in opposite directions transversely to the direction of travel, thereby expanding or at least tensioning the web B1 in a transverse direction. The device can also optionally comprise contactless systems, such as air jets, for example. Particularly preferred is a spreading device, the spreading effect of which can be modified or adjusted—at least using manual adjustment means, but advantageously using remotely actuable adjustment means—(in contrast, for example, to rollers, the spreading effect of which is predetermined solely by their fixed surface texture and/or shape). Preferably, a spreading roller 08 is provided, which is embodied, for example, as a rotatable roller having a curved surface which deviates from cylindrical, and is particularly banana-shaped. In this case, the banana-shaped roller would be oriented in such a way, for example, that the web B1 would interact predominantly with the convex side of the roller. By rotating the alignment relative to the web B1, for example, a degree of spreading can be influenced by dipping the curvature of the center part of the roller to a greater or lesser extent into the plane of the incoming web B1. In an alternative embodiment, the degree of the effect can also be influenced and/or adjusted by altering the radius of curvature (and by the degree of dipping).

The outer surface of the spreading roller 08 that interacts with the web B1 preferably has a surface condition which creates significant frictional contact with the web B1, and is made of rubber, for example, at least in the region of the surface. During a revolution, the surface lines of the surface are first expanded (region of contact with the web B1), for example, and then shrunk ("return path"). The paper "adheres" to the highly non-slip surface, and is stretched by the expanding movement of the rubber outer surface.

A dampening or application device 09; 11, more particularly, a device which operates using water vapor or an application solution and which applies moisture to the first web B1, is preferably provided in the web path between the dryer 02 and the spreading device 08. In a less costly embodiment, a silicone unit 09, for example, formerly advantageous, is provided as the application device 09; 11. Rather than using a silicone unit according to specification in commercial printing presses, in the current application the silicone unit 09 can be operated using a particularly aqueous silicone solution, i.e., with added water in relation to the customary solution.

In an embodiment which is advantageous with respect to the "adjustment range" for dampening, a second dampening or application device 11, particularly a re-dampening device, preferably configured as a second silicone unit 11, is provided in addition to the first dampening or application device 09, for example, downstream thereof, between the dryer 02 and the spreading device 08. The second dampening or application device 11 is preferably operated using a solution that contains a greater concentration of water than that of the first dampening or application device 09, and can also be entirely free of silicone (even in the aforementioned configuration). The second dampening or application device 11 is arranged structurally separately in the web path of the first web B1, so that the solution applied by the first application device 09 has sufficient time to penetrate into the web B1. The distance—at least between the dampening or application devices 09; 11 acting on the same side of the web—should be at least 1 m, for example, advantageously at least 2 m, of web path.

In one variant, the second dampening or application device 11 can also be implemented as an air-ventilated web guide element (e.g., turning bar or deflecting bar), by injecting water, water vapor or a fluid mixture into the gaseous fluid (e.g., air). Said device can be used as the first, as the second, or even as a third, not illustrated, dampening or application device.

The application solution of the one application device 09 or, in the case of two, particularly of the second application device 11, is advantageously laced with agents for reducing surface tension, particularly with surfactants. In the case of two dampening or application devices 09; 11, the application solution of the second application device 11 is laced at least with more surface tension-reducing agent than that of the first.

The web B1 produced in heatset tends toward greater lengthening downstream as compared with a coldset web having the same unwinding length (at the forme cylinder). Moreover, in order to guide the heatset web B1 over the fold former 04 with sufficient web tension, increased web tension must be present upstream of the fold former 04, in other words, between dryer 02 and former structure 03. However, as a result of this, the heatset web B1—which has been shrunk by drying—tends toward creasing. The spreading device 08, combined with an adjustable web tension, allows both of these effects to be counteracted, and allows effective countermeasures to be selectively controlled and/or regulated—at least within a certain adjustment range.

As a particularly advantageous measure in this respect, a positively driven roller 12, particularly a nipping roller 12, is provided in the web path of the first web B1, downstream of the dryer 02, but upstream of the spreading device 08. In a less costly embodiment, one or more driven cooling rollers 12 of a cooling unit 13 may be used as nipping roller 12. The cooling roller(s) is (are) embodied along their length that interacts with the web B1, for example, as having a substantially constant diameter. The nipping roller 12 is driven by a drive motor that is controllable at least with respect to its speed, advantageously with respect to its rotational angle position.

The positively driven roller 12, more particularly, at least one cooling roller 12, and the nipping rollers 06; 07 situated downstream of the spreading device 08 and upstream of the fold former 04, are actuable mechanically independently of one another by means of drive motors and a centralized and/or decentralized drive control system, in such a way that a forward slip or lag and therefore a web tension of the first web upstream of the nipping roller 06; 07, particularly upstream of the former roller 07 and/or upstream of the nipping roller 06 that is located downstream of the spreading device, i.e., also in the region of the spreading device 08, can be adjusted. The nipping roller 06 is driven by a drive motor which can be controlled at least with respect to its speed, advantageously with respect to a rotational angle position.

At least one first infeed unit 14, situated upstream of the first printing unit 01, can also advantageously be driven mechanically independently of the former roller 07 and, if applicable, independently of an additional nipping roller 06 and the nipping or cooling roller 12, situated upstream of the former roller 07, by means of a drive motor and a centralized or decentralized drive control system, such that a forward slip or a lag, and therefore a web tension of the first web B1, can be adjusted downstream of the infeed unit 14.

Figure 2:
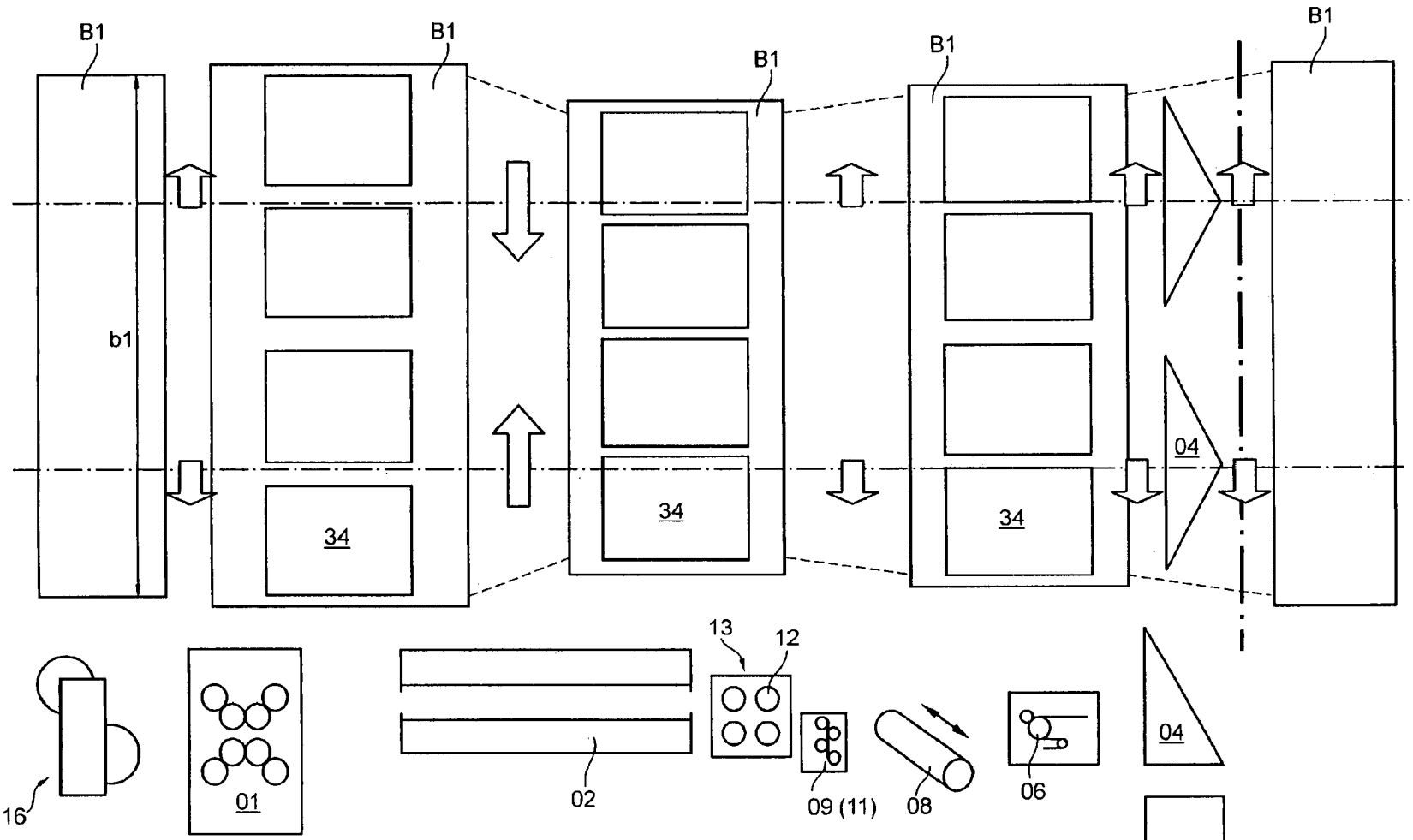
FIG. 2 a schematic illustration of a path of a heatset web through said printing press.

FIG. 2 schematically illustrates the change in a web width b1 of the web B1 and an associated change in an image width during passage through the printing press in heatset operation. The web B1 has an initial web width b1 on the reel in the reel changer 16, and exits the printing unit 01 with an expanded width as a result of the dampening during printing. In the dryer 02 it undergoes substantial shrinkage. By re-dampening in one or more dampening or application devices 09; 11 and with spreading, it is expanded again somewhat, and any creases are removed. As it is guided over the fold former 04, it can optionally be subjected to additional transverse stretching.

The aforementioned measures, alone or in combination, are of particular advantage in the production of products or partial products in heatset processes. These measures are of particular value in printing presses which—in contrast to commercial printing presses—are used primarily to produce newspaper products and semi-commercial products (e.g., advertising inserts or lower quality, often free flyers, such as city circulars, etc.). The latter products are not subject to the high standards of quality for magazines or catalogs, but do have requirements beyond those of pure newspaper coldset printing. Therefore, using a suitably modified newspaper printing press, a very high output can be achieved with a substantially lower specific investment as compared with commercial printing presses. In the newspaper printing press, a plurality of printing towers, for example, two, three or more, for a plurality of webs—each with a substantially vertical web path—can produce simultaneously, side by side, in a small amount of space, on the same former structure 03 and/or folding unit 18.

However, the aforementioned measures are particularly advantageous in a printing press, particularly a newspaper printing press, comprising a plurality of printing units or printing towers for a plurality of webs, when combined with the possibility of so-called hybrid production, i.e., in this case the possibility of a combined production using coldset and heatset web(s), wherein at least one dryer 02 is provided for drying at least one of the webs. What is problematic in this case, however, are the generally different print substrates (types of paper) that are used simultaneously and will be combined, and the processes, which differ from one another in terms of the drying, both of which are expressed in different behavior with respect to growth or shrinkage of the web and therefore of the print image, and/or web tension and expansion properties.

For this purpose, the printing press has at least one first printing unit 01 or at least one corresponding printing tower for imprinting a web B1 in heatset, and at least one or more second printing units 02 (or one or more corresponding printing towers), each with at least one offset printing couple for printing one or both sides of one or more second webs B2 (in FIG. 1 only one printing tower with second printing units is shown). Means for guiding the second web B2 are also provided, via which the second web B2 can be or is guided, together with the first web B1, to the at least one fold former 04, without passing through a dryer or at least without passing through an activated dryer.

The second printing unit 21 is embodied as a coldset printing unit 21 (or, as mentioned above, as a printing unit for waterless offset printing, dry offset), or the second web B2 is at least processed in coldset.

This second web B2 is embodied as a coldset web B2, for example, having a coat weight that is different from the first web B1, particularly as uncoated or lightly coated paper having a maximum coat weight of 20 g/m$^2$, particularly a maximum of 10 g/m$^2$, preferably as newsprint paper. It can particularly have a different base weight from that of the first web B1, particularly within a base weight range of less than 55 g/m$^2$, for example, in a base weight range of 35-55 g/m$^2$.

Transfer cylinders 22 of the second printing unit 21 that interact with the coldset web B2 can have a compressible and/or flexible printing blanket, the elastic properties of which are different from those of a transfer cylinder 16 that interacts with the heatset web B1. In this case, the printing blanket of the (heatset) transfer cylinder 22 can be chosen to be less positively or more negatively conveying, for example, than that of the (coldset) transfer cylinder 16. Additionally or alternatively, an undisrupted outer surface of the (heatset) transfer cylinder 22, i.e., in which the printing blanket is in the non-depressed state, can be different from that of the (coldset) transfer cylinder 16 (e.g., smaller). This allows compensation in advance for errors which can result during the continued travel of the web from an extension of the printing length on the heatset web B1 as a result of the different material properties and web handling (drying). The different circumferences can be generated, for example, through different printing blanket thicknesses or, in the case of equal printing blanket thicknesses, by sublayers.

Downstream of the printing unit 21, a nipping roller 24 for a slitter 31 can be provided. This is the case when a multi-width web B2 (e.g.: double- or triple-width, i.e., to be imprinted or imprintable with four or six newspaper pages, respectively) will be imprinted and, before reaching the former structure 03, will be cut into partial webs which are one or two pages in width, and, if applicable, a partial web will be offset laterally and/or dropped over a turning deck 32 having two turning bars. The web path of the second web B2 is embodied, for example, without spreading device and/or without dryer and/or without cooling rollers.

For conveyance and to ensure desired web tension levels, at least one positively driven roller, particularly nipping roller 23; 24, is provided in the web path of the second web B2, downstream of the second printing unit 21 but upstream of the former roller 07. In this case, preferably at least the at least one nipping roller 23; 24 for the second web B2 and the former roller 07 are actuable mechanically independently of one another and of the positively driven roller 12 for the first web B1, by means of drive motors and a centralized and/or decentralized drive control system, in such a way that a forward slip or lag, and therefore a web tension of the second web B2, is adjustable particularly independently of the first web B1, upstream of the former roller 07. The top web should have a higher web tension on the fold former, for example, than the bottom web. If, for example, the heatset web B1 (or a partial web produced from said web) will be advantageously guided as the top section onto one or more coldset webs B2 (or partial webs), the web tension of the covering heatset web B1 should be higher than that of the coldset (partial) web B2 beneath it. For adjustment purposes, a second infeed unit 26, situated upstream of the second printing unit 21, should also be driveable mechanically independently of the former roller 07 by a drive motor and a centralized and/or decentralized drive control system, in such a way that a forward slip or lag, and therefore a web tension of the second web B2, can be adjusted downstream of the infeed unit 26.

With one or more of these measures, the lag of the positively driven roller 12 for the first web B1, provided upstream of the spreading device 08, in relation to the former roller 07, can be chosen to be higher than the lag of the nipping roller 24 positioned closest upstream of the former roller 07 in the web path of the second web B2.

The effect of the spreading device 08 on the first web B1 can preferably be embodied as adjustable by adjusting the spatial position of a curvature and/or a change in the degree of curvature and/or the prevailing web tension of the first web B1 in the region of the spreading device 08. The web tension can preferably be regulated by adjusting the lag and/or forward slip between the positively driven roller 12 situated upstream of the spreading device and the nipping roller 06; 07 situated closest downstream therefrom.

In one advantageous embodiment, the amount of application solution to be applied to the first web B1 is also embodied as adjustable by means of a corresponding control element.

The aforementioned adjustability of the spreading device and the application amount, along with the control and/or regulation measures described below, applies to the above consideration of isolated heatset operation, but particularly advantageously to the adjustment of image widths in hybrid operation in a hybrid printing press.

For purposes of adjustment, a measuring system 27 for assessing web shrinkage in a transverse direction, particularly by detecting a web width and/or web position, for example, using web width sensors, and/or by detecting a print image width or print image position, for example, using register scanning heads, is provided preferably at least in the web path of the heatset web B1, upstream of the former roller 07. To correct lateral web offset, a corresponding deflecting device 17, for example, a pivoting frame 17, can be provided in the web path upstream of the printing unit 01 and/or downstream of the dryer 02.

In a modification, the measuring system 27 can also be embodied alternatively or additionally to detect creases or waves formed in the web B1. For this purpose, this system is embodied, for example, as an optical system, particularly, for example, as a line or surface camera, with corresponding evaluation software, which detects an actual status that differs from the target status, and generates a corresponding output. This output can then be used in the regulation or control with respect to web tension and/or dampening and/or spreading, described below.

Additionally, in one advantageous embodiment, a measuring system 28 for detecting web tension can be provided in the web path of the first web B1, at least upstream of the former roller 07, particularly in the web section having the spreading device 08, between the positively driven roller 12 and the nipping roller 06; 07 situated downstream of the spreading device.

To be able to influence the print image or web width of the first web B1, particularly in the case of a hybrid printing press or hybrid operation, a unit 29, for example, a control and/or regulating unit 29, is preferably provided, which is connected in terms of signals to one or more of the measuring systems, for example, to the measuring system 27 for assessing web shrinkage and/or wave/crease formation and/or to the measuring system 28 for detecting web tension, and preferably to one or more of the control elements, for example, to an element for controlling the amount of application solution to be applied to the first web B1 and/or to a control element for influencing spreading (adjusting rotational position or curvature) and/or to a centralized or decentralized drive control system for at least one of the driven rollers 06; 12; (14) that interacts with the first web B1, i.e., a roller of the infeed unit 14 and/or the positively driven roller 12 and/or an additional nipping roller 06 situated upstream of the former roller 07.

In an advantageous embodiment, the unit 29 comprises at least means by which a measurement of a shrinkage and/or wave or crease formation can be determined and/or provided by the received measured values. In principle, the press operator can then initiate a correction—e.g., via an operating field in the unit 29, which is then embodied at least as an output unit, or via a corresponding unit on the printing press control console—using a control command for one or more of the aforementioned adjustment factors (dampness, spreading effect, web tension). In one advantageous embodiment, however, the unit 29 embodied as a control and/or regulating unit 29 can itself be used to operate an element for controlling web tension, for example, a drive regulator or a drive controller, and/or an element for controlling the amount of application medium to be applied and/or a spreading effect. In this case, the control and/or regulating unit 29 comprises electronic computing or evaluating means, via which one or more of the control elements is adjusted according to established rules, for example, an algorithm, on the basis of a detected shrinkage. The control and/or regulating unit 29 can also be a module of an "automatic web tension control system" (i.e., a system for automatically regulating the web tension of the webs involved in production) or can at least interact with such a system with respect to the aforementioned adjustments to web tension. The control element for influencing web tension (e.g., drive of a roller 12; 06; 07 or of infeed unit 14) is then influenced directly by the control and/or regulating unit 29 by acting on a web tension control or regulating system.

In an alternative or further development, unit 29 is assigned an electronic memory, in which (pre) adjustment values for the control elements to be adjusted with respect to shrinkage, for example, on the basis of data that characterize the paper that will be used (e.g., type of paper), and/or data relating to the print image (e.g., area coverage) and/or a web path, are stored or can be stored and retrieved as needed, manually by the press operator, or using an algorithm of the control and/or regulating unit 29, for a planned production run.

Figure 3:
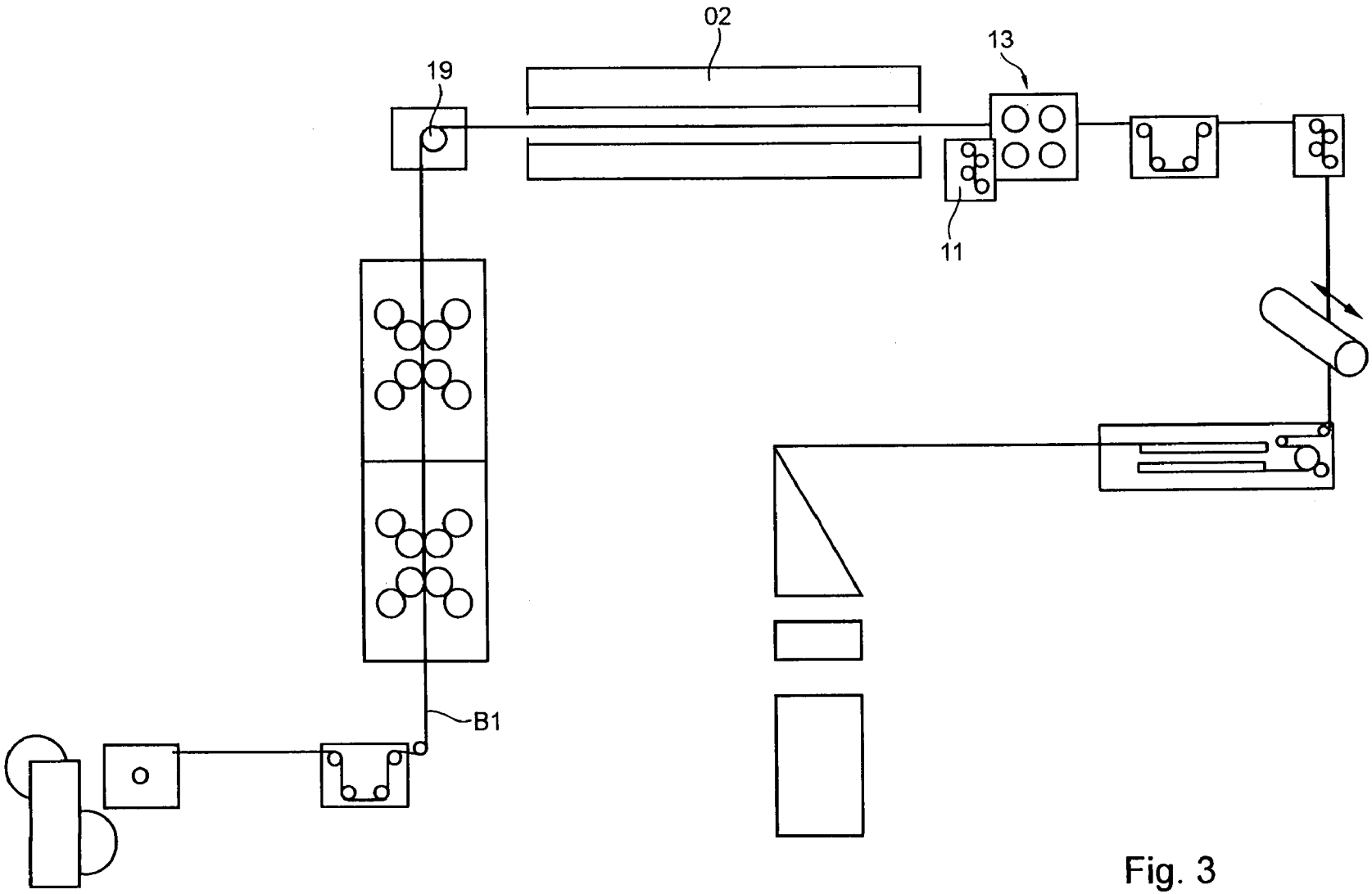
FIG. 3 a second embodiment of a heatset path in a printing press.
Figure 4:
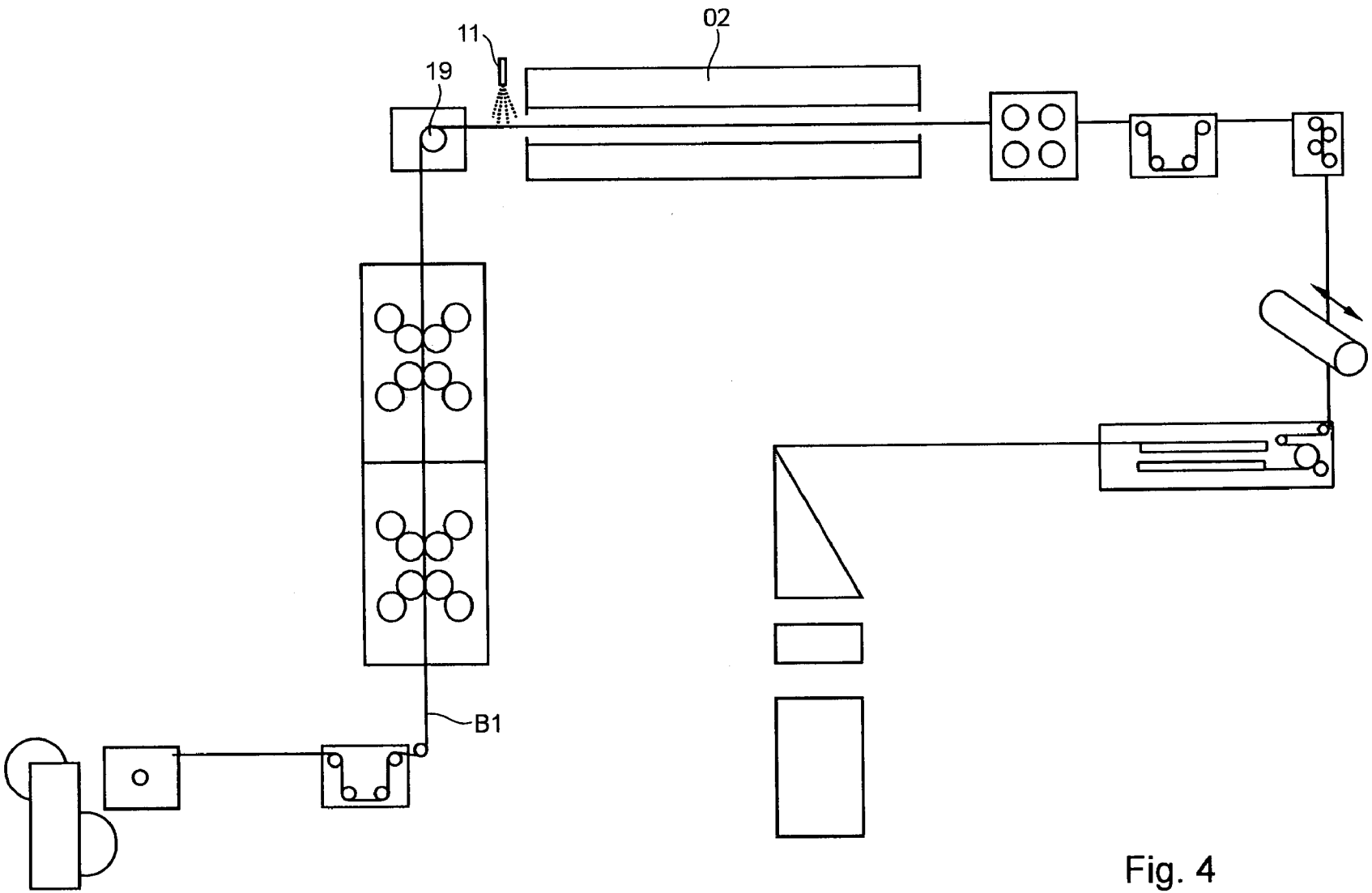
FIG. 4 a third embodiment of a heatset path in a printing press.
Figure 5:
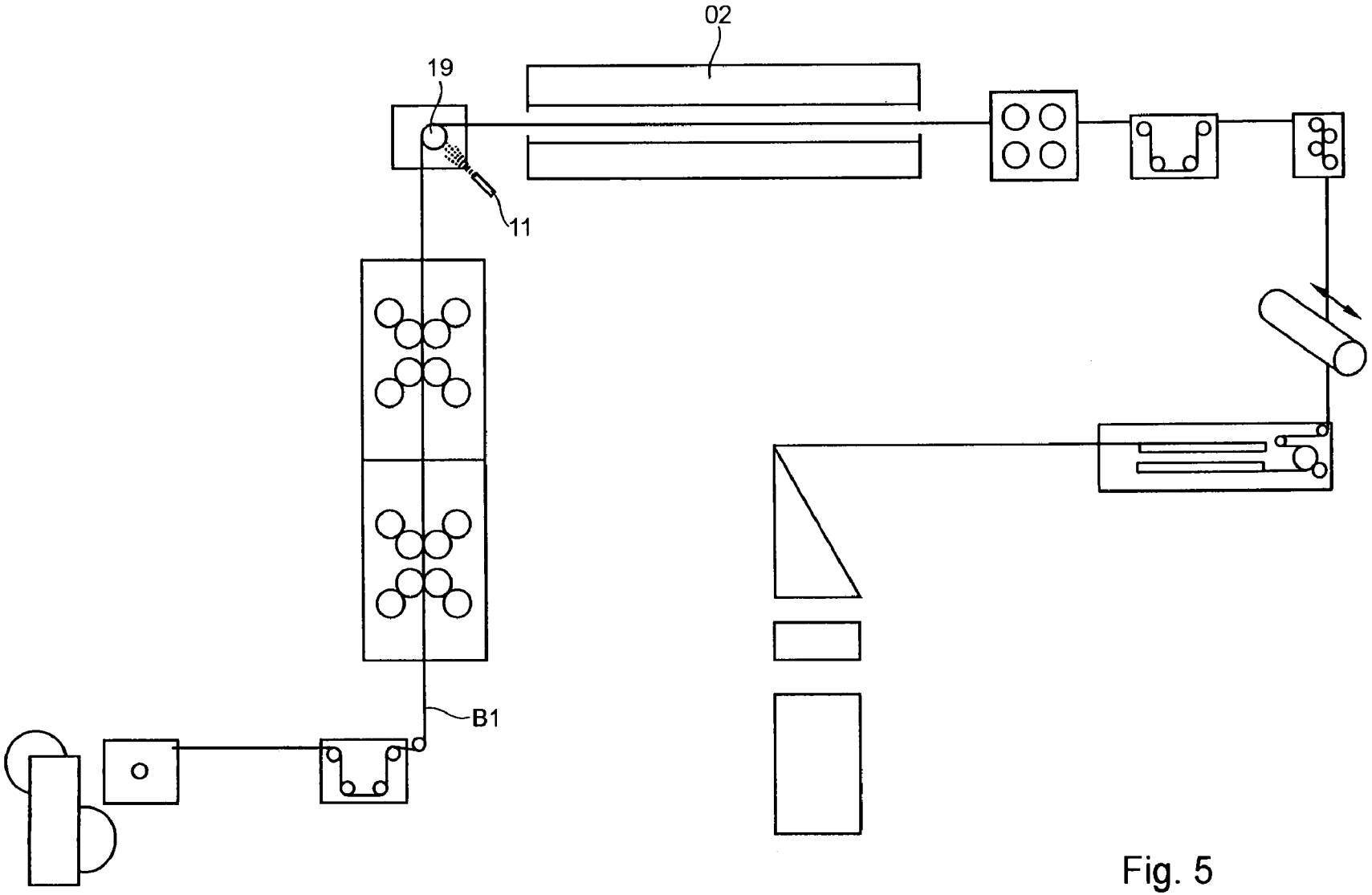
FIG. 5 a fourth embodiment of a heatset path in a printing press.
Figure 6:
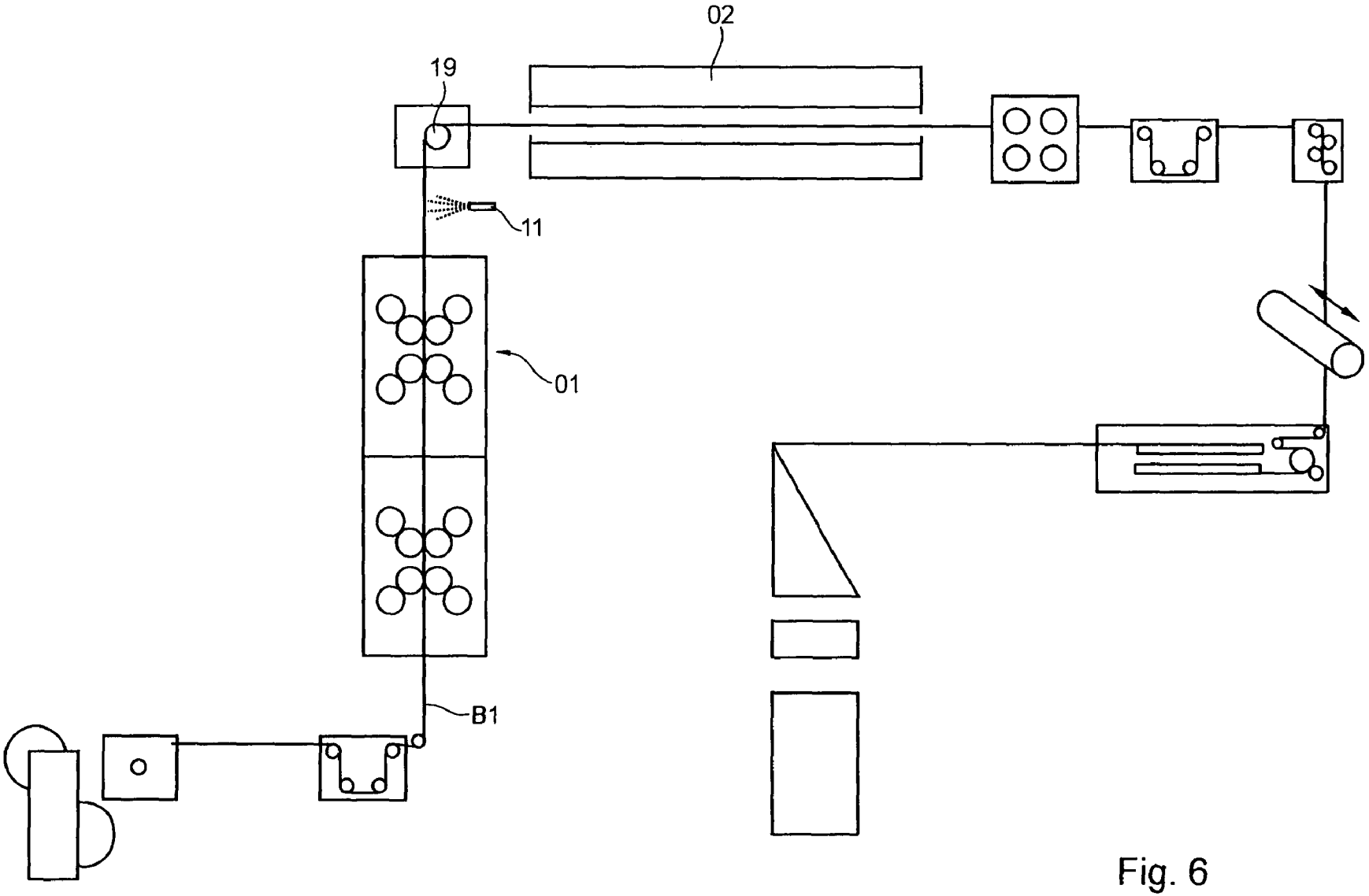
FIG. 6 a fifth embodiment of a heatset path in a printing press.

FIGS. 3 to 6 show alternative embodiments of the printing press along the web path of the heatset web B1, wherein these can be used alone or advantageously as alternatives for the heatset branch of the hybrid printing press shown in FIG. 1. In FIG. 3, the second dampening or application device 11 is arranged in the web path between dryer 02 and cooling unit 13 (and optionally integrated into the intake region of the cooling unit). In FIG. 4, a dampening or application device 11, for example, in the form of spray or steam nozzles, is located upstream of the intake to the dryer 02, whereas in FIG. 5 it is located in the region of the porcupine roller 19, which is upstream of the dryer 02, and in FIG. 6 it is located between printing unit 01 and porcupine roller 19.

The embodiment and/or arrangement of dampening or application devices 11 illustrated in FIGS. 3 to 6 can be provided individually or in multiples, additionally or alternatively to the first and/or second dampening or application device 09; 11. However, it is particularly advantageous to provide at least one dampening or application device 09; 11 between dryer 02 and spreading device 08.

In the printing press, the heatset web B1 is first guided through the printing unit 01 and imprinted on one or both sides, in a single- or multi-color process, and is then processed through the dryer 02, before it is fed downstream over a nipping roller 06; 07, situated upstream of a fold former 04, to the fold former 04 of the former structure 03. In this case, the heatset web is acted on, in its path between dryer 02 and fold former 04, by a web stretching device 08 having force components which stretch the web transversely to its longitudinal direction. The first web B1 is preferably selectively re-dampened by a dampening device 09; 11, at least between dryer 02 and spreading device 08.

In an advantageous embodiment, a shrinkage (in the transverse direction) and/or formation of waves in the heatset web 01 guided through the dryer 02 is determined in the web path between dryer 02 and fold former 04, and is selectively influenced by the degree of action of the spreading device 08, for example, using the web tension as a control element (forward slip/lag of the nipping rollers 06; 07; 12 or of the infeed unit and/or the position or curvature of the spreading device 08) and/or the amount of application medium of the at least one dampening device 09; 11. Conversely, a minimum level of web tension to be maintained by the web B1 at the fold former 04 is preferably enabled by adjusting the spreading effect and/or dampening such that for this web tension, shrinkage and/or fold formation is limited to a permissible level. This correlation makes it possible to adjust a sufficiently high level of web tension in the first web B1 (e.g., in hybrid operation, in relation to the web tension of a coldset web B2), particularly advantageously before it is combined with a second web B2 (coldset web B2), without the heatset web B1 (first web B1) having an impermissibly high level of shrinkage or creasing or wave formation (or alternatively, a level of web tension that is too low being present). The behavior with respect to web tension and web transport, which is substantially different for coldset and heatset webs, can thereby be controlled.

In advantageous hybrid operation, the first web B1 imprinted or produced by the first printing unit 01 in heatset, or a first partial web produced from this web by slitting, is processed together with a second web B2 imprinted or produced in a second printing unit 21 in coldset, or a second partial web obtained from this web by slitting, together via the same fold former 04, to form a ribbon. In this case, shrinkage is influenced, for example, by one or more of the aforementioned factors (dampening and/or spreading effect and/or web tension) in terms of a reduction in a difference between the web widths or partial web widths of the first and second web B1; B2 or partial web and/or in terms of a web tension to be maintained in the first web B1 upstream of the former intake.

The specified means and methods are particularly advantageous in connection with printing presses having first and second printing units 01; 21 or printing towers, wherein the first and second printing units 01; 21 are embodied as multi-width, for example, double- or triple-width, and/or in at least one operating situation, in each of the printing couples of the first and second printing units 01; 21 at least four vertical or horizontal printed pages, particularly newspaper pages, of the same format, are imprinted on first and second webs B1; B2, and/or partial webs of first and second webs B1; B2 are processed to form a combined product, and are particularly guided over the same fold former 04. In particular, for example, a plurality of second webs B2 (as coldset webs B2) and at least one first web B1 (as heatset web B1) are processed to produce a combined product.

While preferred embodiments of a printing press, of methods for using the printing press, and of methods for handling a web guided through a printing press, all in accordance with the present invention, have been set forth fully and completely hereinabove, it will be apparent to one of skill in the art that various changes could be made without departing from the true spirit and scope of the present invention which is accordingly to be limited only by the appended claims.

What is claimed is:

1. A printing press comprising:

at least one first printing tower having at least one first type of a first printing unit;

a plurality of offset printing couples in said first printing unit for printing at least one of one and both sides of a first web, which first web passes through the first printing unit substantially from a printing unit bottom to a printing unit top and which first web is to be imprinted in the first printing tower in a multi-color process;

a web dryer located downstream of the first printing unit in a web travel path of the first web;

a former structure having at least one fold former through which the first web passes, and which former structure is located after, in the web travel path, the dryer;

at least one nipping roller located downstream of the dryer in the web travel path and upstream of the fold former;

a printed web spreading device in the web travel path of the first web, between the dryer and the at least one nipping roller that is located upstream of the fold former; and a positively driven roller which is controllable at least with respect to one of its speed and with respect to a rotational angle position, said positively driven roller being provided in the web travel path of the first web, downstream of the dryer and upstream of the printed web spreading device.

2. The printing press according to claim 1, including at least one second printing tower having at least one second type of a second printing unit having a plurality of offset printing couples and adapted for printing on at least one and both sides of a second web, which second web passes through the second printing unit substantially from a second printing unit bottom to a second printing unit top and which second web is to be imprinted in the second printing tower in a multicolor process, and further including means for guiding the second web and by which, the second web can be guided, together with the first web, to the at least one fold former, without passing through an activated dryer.

3. The printing press according to claim 1, further including at least one of a dampening and an application device adapted to apply moisture to the first web and which operates using at least one of water vapor and an application solution, said one of said dampening and application device being provided in the web travel path between the dryer and the printed web spreading device.

4. The printing press according to claim 3 wherein at least one silicone unit is provided as the application device between the dryer and the spreading device.

5. The printing press according to claim 3, wherein the at least one of a dampening and an application device, is operated using an aqueous silicon solution.

6. The printing press according to claim 5, wherein, a first one of a dampening and an application device, is provided between the dryer and the spreading device, and a second one of a dampening and an application device, is arranged spaced from the first one of a dampening and an application device in the web path, wherein the second one of a dampening and an application device is operated using a solution that contains a second concentration of water greater than a first concentration of water used in the first one of a dampening and an application device.

7. The printing press according to claim 6, wherein the application solution of the second one of a dampening and an application device is provided with a media for reducing surface tension and has a second concentration of the media for reducing surface tension higher than a first concentration of the media in the first one of a dampening and an application device.

8. The printing press according to claim 1, wherein the positively driven roller is a cooling unit nipping roller of a cooling unit which is provided in the web path of the first web between the dryer and the spreading device.

9. The printing press according to claim 8, characterized in that at least the cooling unit nipping roller, and the at least one nipping roller located downstream of the spreading device and upstream of the fold former, can be driven mechanically independently of one another in such a way that one of a relative forward slip and lag, and therefore a web tension of the first web in the section between the cooling unit nipping roller located upstream of the spreading device and the at least one nipping roller located downstream of the spreading device, can be adjusted.

10. The printing press according to claim 1, wherein that at least one first infeed unit, which is located upstream of the first printing unit can be driven mechanically independently of a former roller of the former structure and the at least one nipping roller situated upstream of the former roller can be driven, in such a way that one of a forward slip and lag, and therefore a web tension of the first web downstream of the infeed unit, can be adjusted.

11. The printing press according to claim 1, wherein the first printing unit is a heatset printing unit using one of heatset inks and UV inks.

12. The printing press according to claim 1 the first web is embodied as a heatset web comprising one of a glazed and heavily coated paper having a coat weight of more than 10 $g/m^2$, and within a base weight range of greater than 40 $g/m^2$.

13. The printing press according to claim 1, characterized wherein at least one of said plurality of offset printing couples of the first printing unit has a transfer cylinder, which comprises one of a first compressible and flexible printing blanket and has a first undisrupted outer surface when the printing blanket is in a non-depressed state.

14. The printing press according to claim 1, wherein the spreading device is embodied as a spreading roller having an adjustable spreading effect.

15. The printing press according to claim 14, characterized in that the spreading roller is embodied as a rotatable roller having a curved surface that is adapted to deviate from a cylindrical shaped surface.

16. The printing press according to claim 14 characterized wherein an outer surface of the spreading roller that interacts with the first web has a surface condition which forms significant frictional contact with the web.

17. The printing press according to claim 1 wherein the dryer located in the path of the first web is activated.

18. The printing press according to claim 1, further including at least one second printing tower with a second printing unit having at least one offset printing couple for printing at least one of one and both sides of a second web, and further including means for guiding the second web and with which the second web can be guided, together with the first web, to the at least one fold former, without passing through an activated dryer.

19. The printing press according to claim 2, wherein the second printing unit is embodied a as coldset printing unit and is operated using coldset inks.

20. The printing press according to claim 1, wherein a second web is embodied as a coldset web comprising one of uncoated and lightly coated paper having a maximum coat weight of 10 $g/m^2$.

21. The printing press according to claim 20, characterized in that the second web, which is embodied as a coldset web, has a base weight which particularly lies in a base weight range of less than 55 $g/m^2$.

22. The printing press according to claim 15, wherein the curved surface of the spreading roller is adjustable.

23. The printing press according to claim 13 wherein at least one of an offset printing couple of a second printing unit has a second transfer cylinder, which has a second one of a compressible and flexible printing blanket and a second undisrupted outer surface, and wherein the first transfer cylinder and the second transfer cylinder differ from one another in terms of one of the undisrupted outer surfaces and/or the flexible properties of the printing blankets thereof.

24. The printing press according to claim 2, wherein at least one positively driven second web roller is provided in a web path of the second web, downstream of the second printing unit and upstream of a former roller of the former structure.

25. The printing press according to claim 24, wherein the at least one positively driven second web roller of the second web and the former roller can be driven mechanically independently of one another and of the positively driven roller of the first web in such a way that one of a forward slip and lag and therefore a web tension of the second web, can be adjusted independently of the first web, upstream of the former roller.

26. The printing press according to claim 2, further including at least one second infeed unit that is located upstream of the second printing unit and that can be driven mechanically independently of a former roller of the former unit in such a way that one of a forward slip and lag and therefore a web tension of the second web can be adjusted downstream of the at least one second infeed unit.

27. The printing press according to claim 25, wherein the lag of the positively driven roller of the first web, and which is provided upstream of the spreading device, is chosen to be greater than the lag of the positively driven second web roller that is situated closest upstream of the former roller in the web path of the second web.

28. The printing press according to claim 15, wherein an effect of the spreading device by a change in one of a degree of a curvature and the prevailing web tension of the first web is embodied as being adjustable in the region of the spreading device (08).

29. The printing press according to claim 8, wherein a web tension in the first web can be regulated by adjusting one of a lag and a forward slip between the positively driven roller that is located upstream of the spreading device and the at least one nipping roller located downstream from the spreading device.

30. The printing press according to claim 3, characterized in that an amount of an application solution to be applied to the first web is adjustable.

31. The printing press according to claim 1, further including a measuring system adapted to assess at least one of a web shrinkage in a transverse direction, over a web width and a web position and a print image width and a print image position, and at least one of creases and the formation of waves, and which measuring system is provided at least in the web travel path of the first web, upstream of the former structure.

32. The printing press according to claim 1, further including a measuring system for detecting web tension which is provided at least in the web travel path of the first web, upstream of the former structure in a section of the web travel path that has the spreading device and which is located between the positively driven roller and the at least one nipping roller that is located downstream of the spreading device.

33. The printing press according to claim 1, further including one of a control unit and a regulating unit and which is connected to a measuring system for evaluating one of web shrinkage and the formation of waves and to one of a measuring system for detecting web tension and to an element for controlling an amount of an application solution to be applied to the first web and to a control element for influencing web tension and to a control element for influencing an effect of the spreading device.

34. The printing press according to claim 33 wherein the one of the control unit and the regulating unit comprises means to determine at least one of a measurement of shrinkage and creasing in.

35. The printing press according to claim 33, wherein the one of the control unit and the regulating unit includes means for at least one of controlling web tension, for controlling an amount of an application medium to be applied and for adjusting a spreading effect accomplished by the spreading device.

36. The printing press according to claim 35 wherein the one of the control unit and the regulating unit comprises means for implementing one or more of the control elements according to established rules on the basis of a detected shrinkage of the web.

37. The printing press according to claim 33, wherein the one of the control unit and the regulating unit is provided with an electronic memory, in which adjustment values for the control elements to be adjusted with respect to at least one of shrinkage and creasing, are stored.

38. A method for handling a first web and a second web being guided through a printing press including:

providing a first printing tower having at least a first printing unit including a plurality of first offset printing couples;

directing the first web in a first web path of travel through the first printing tower substantially from a first printing tower bottom to a first printing tower top and imprinting the first web in a first multi color heatset printing process;

providing a dryer and locating the dryer after, in the first web path of travel, the first printing tower;

activating the dryer;

directing the first web printed in the first printing tower through the activated dryer;

providing a former structure having a fold former and locating the former structure after, in the first web path of travel, the dryer;

providing a positively driven roller in the first web path of travel and after the dryer;

providing a nipping roller in the first web path of travel after the positively driven roller and before the fold former;

providing a web spreading device in the first web path of travel and locating the web spreading device after the positively driven roller and before the nipping roller;

providing the web spreading device with force components adapted to stretch the first web transversely to the first web path of travel;

providing a second printing tower having at least a second printing unit including a plurality of second offset printing couples;

directing the second web in a second web path of travel through the second printing tower substantially from a second printing tower bottom to a second printing tower top and imprinting the second web in a second multi color coldset printing process;

directing the second web in the second web travel path to the fold former without passing through an activated dryer; and processing the first web and the second web in the form folder and forming a ribbon after guiding the first web over the positively driven roller, the spreading device and the nipping roller that is located before the form folder.

39. The method according to claim 38, further including providing a dampening unit between the dryer and the spreading device and selectively re-dampened the first web in the dampening unit.

40. The method according to claim 39, further including identifying one of a shrinkage in the transverse extension and creasing in the first web guided through the dryer in the first web path of travel between the dryer and fold former, and selectively influencing the one of shrinkage and creasing using one of a degree of an effect of the spreading device and an amount of application of a dampening medium by the at least one dampening device.

41. The method according to claim 40, further including influencing the one of shrinkage and creasing in terms of reducing a difference between the web widths of the first and second webs.

42. The method according to claim 40, further including adjusting one of a degree of the effect of the spreading device and the amount of application of a dampening medium of the at least one dampening device in terms of a desired web tension.

* * * * *